US005096330A

United States Patent [19]

Artzberger

[11] Patent Number: 5,096,330

[45] Date of Patent: Mar. 17, 1992

[54] PITCH CONTROL MECHANISM FOR A SURFACE FINISHING MACHINE

[75] Inventor: Thomas G. Artzberger, Menomonee Falls, Wis.

[73] Assignee: M-B-W Inc., Slinger, Wis.

[21] Appl. No.: 541,378

[22] Filed: Jun. 21, 1990

[51] Int. Cl.[5] ..... E01C 19/22; F16H 27/02

[52] U.S. Cl. ..... 404/97; 404/112; 74/89.15

[58] Field of Search ..... 404/97, 112; 74/89.15, 74/424.8 R

[56] References Cited

U.S. PATENT DOCUMENTS

| | | | |
|---|---|---|---|
| 2,942,536 | 6/1960 | Irwin | 404/112 |
| 3,552,194 | 1/1971 | Hawes | 74/89.15 |
| 3,738,229 | 6/1973 | Kraft | 92/17 |
| 4,062,075 | 12/1977 | Stern et al. | 5/68 X |
| 4,408,485 | 10/1983 | McGill | 166/237 X |
| 4,434,677 | 3/1984 | Linley | 74/89.14 X |
| 4,494,025 | 1/1985 | Fickler | 74/89.15 X |
| 4,657,201 | 4/1987 | Munroe | 242/295 X |
| 4,673,311 | 6/1987 | Whiteman | 404/112 |
| 4,807,452 | 2/1989 | Brenner | 74/23 |
| 4,878,779 | 11/1989 | Whiteman | 404/112 |

*Primary Examiner*—Ramon S. Britts
*Assistant Examiner*—Nancy P. Connolly
*Attorney, Agent, or Firm*—Andrus, Sceales, Starke & Sawall

[57] ABSTRACT

A pitch control mechanism for a surface finishing machine. The machine inclueds a series of tiltable horizontal blades carried by a rotor and the blades are adapted to rotate in contact with and finish a concrete surface. The pitch control mechanism for tilting the blades includes an internally threaded sleeve located within the handle of the machine. The sleeve is operably connected through a cable to the blades and the sleeve is threaded to a rod or shaft. The engaged threads of the sleeve and the shaft have a pitch in the range of two to six threads per inch. The shaft is mounted for rotation in a manner such that a relatively small frictional resistance to rotation of the shaft occurs when the shaft is rotated in a direction to tilt the blades from a horizontal to a tilted position, but a substantially increased frictional resistance occurs when the blade is rotated in the opposite direction to thereby prevent free rotation of the shaft and unthreading of the threads due to the weight of the machine acting on the tilted blades.

12 Claims, 1 Drawing Sheet

PITCH CONTROL MECHANISM FOR A SURFACE FINISHING MACHINE

BACKGROUND OF THE INVENTION

Power operated trowels or finishing machines are used to finish the surface of concrete slabs. The typical finishing machine includes a plurality of blades which are mounted on the lower end of a central rotor, and a gasoline engine is operably connected to the rotor and serves to rotate the blades directly against the concrete surface. The typical finishing machine includes a mechanism for varying the pitch of the blades. Each blade is pivoted about a longitudinal horizontal axis and can be pivoted from a generally horizontal position to a tilted position where the blade extends at an angle to the horizontal.

The pitch of all the blades is changed simultaneously and by varying the pitch, the amount of the blade surface contacting the concrete slab is varied, so that the machines weight is carried by a larger or smaller area of the blade.

The pitch of the blades is frequently varied as the operator moves the machine over the concrete slab. For example, when the concrete is fresh or wet, the blade pitch will normally be adjusted so that the blades are generally horizontal. As the concrete hardens, the blade pitch can be progressively increased. Further, when the concrete slab is uneven and contains high and low areas, the operator may wish to rapidly change the pitch as the machine is moved between the high and low areas.

The trailing edges of the blades are spaced laterally from the blade pivot axis and as the blades are tilted from a horizontal to an inclined or tilted position, the machine is correspondingly raised relatively to the concrete slab. As the machine is heavy, weighing several hundred pounds, the pitch changing mechanism should enable the operator to tilt the blades quickly and with minimum effort.

In the past, a threaded pitch control mechanism has been utilized to vary the pitch of the blades. In the typical pitch control mechanism, a rod or shaft is mounted within the handle of the machine, and the lower end of the shaft is threaded to a sleeve which, in turn, is connected to a cable that extends downwardly within the handle and is connected to the pitch control lever. By rotating the shaft through operation of a hand knob, the sleeve will be moved axially within the handle to thereby tilt the blades relative to the surface to be finished. The threaded connection between the shaft and the sleeve in the conventional machine has had a pitch of at least eight threads per inch, thereby requiring eight revolutions of the hand knob to move the sleeve one inch and provide a tilt of approximately 10°. Because of the large number of revolutions required to substantially change the pitch, control mechanisms of this type have been relatively slow and have not satisfied the operator's need for a rapid pitch control. It has not been practical in the past to change the pitch of the threaded connection to a lesser number of threads per inch, because the weight of the machine acting on the tilted blades will tend to back off the threaded connection, so that the blade pitch cannot be maintained.

Published PCT application WO87/90221 discloses a pitch control mechanism for a concrete finishing machine, which utilizes a lever control rather than a threaded connection. In addition, the pitch control device of the aforementioned application incorporates a counterbalancing spring which is connected to the control lever and applies a counterbalancing force to enable the lever to be moved with considerably less force than would otherwise be required.

However, the lever-type blade pitch control has certain disadvantages. The lever mechanism has a series of incremental locked positions, and thus it does not have infinite pitch control, so that the operator does not have precise pitch control as with a screw or threaded type of pitch adjustment.

As a further disadvantage, the force of the counterbalancing spring associated with the lever type of pitch control mechanism is designed for a given weight of machine. If the weight changes, as for example by changing the engine, the counterbalancing force has to be readjusted.

The typical power operated trowel machine is moved or pushed manually across the concrete slab by the operator. With a lever-type of pitch control mechanism, a pushing force applied to the lever may tend to move the machine in a direction which is unwanted by the operator and to prevent this, the operator will normally stop movement of the machine over the slab when the pitch adjustment is made.

SUMMARY OF THE INVENTION

The invention is directed to an improved pitch control mechanism for a surface finishing machine, such as concrete finishing machine. The machine includes a series of tiltable horizontal trowel blades that extend outwardly from a central rotor. The pitch control mechanism comprises a rod or shaft that is disposed within the handle of the machine, and is threaded to a tubular sleeve which is connected via a cable to the pitch control levers. The threaded connection between the shaft and the sleeve contains in the range of two to six threads per inch.

The shaft is mounted for rotation relative to the handle in a manner such that a relatively small frictional resistance occurs when the shaft is rotated in a direction to tilt the blades from a horizontal position to a tilted or inclined position, but increased frictional resistance is encountered when the shaft is rotated in the opposite direction, thereby preventing free rotation of the shaft and unthreading of the connection due to the weight of the machine acting on the titled blades.

This journalling arrangement is preferably accomplished by mounting a hub around the upper end of the shaft and a hand knob is attached to the shaft and is journalled on a thrust bearing which is located between the knob and the hub. The thrust bearing has a relatively low coefficient of friction, thereby permitting the knob and attached shaft to be readily rotated in a direction to tilt the blades from a horizontal attitude to an inclined or tilted attitude.

In addition, a thrust bearing or washer having a relatively high coefficient of friction is interposed between the hub and a cap attached to the handle, and a one-way clutch interconnects the hub and the knob. The clutch permits rotation of the knob relative to the hub when the blades are moved from the horizontal to the inclined position, but prevents relative rotation between the knob and the hub in the opposite direction. On reverse manual operation of the knob, the hub will then rotate against the friction washer which provides sufficient frictional resistance to prevent the threaded connection between the shaft and the sleeve from backing off due to the weight of the machine.

By utilizing a low pitch in the threaded connection, i.e. preferably two threads per inch, the pitch of the trowel blades can be rapidly varied to provide more precise control of the finishing operation. For example, only two turns or revolutions of the hand knob are required to provide a blade pitch change of about 10°, yet the threaded connection is self-locking and will not back off due to weight of the machine acting on the tilted blades.

As the blade pitch control mechanism includes a threaded connection, an infinite control is achieved as opposed to an incremental control that accompanies a lever-type of operation.

The pitch control mechanism of the invention can be operated with a relatively small force and without the need of counterbalancing elements.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
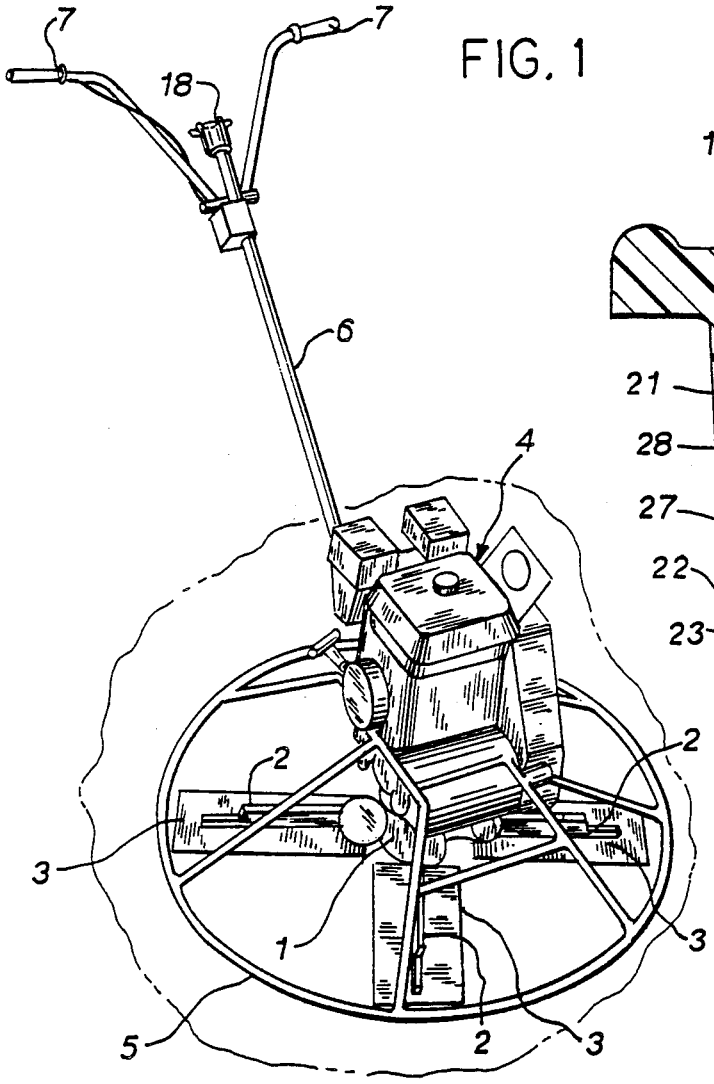
FIG. 1 is a perspective view of a power trowel incorporating the pitch control mechanism of the invention.

FIG. 1 shows a typical surface finishing machine or power trowel incorporating the pitch control mechanism of the invention. The trowel includes a central rotor 1 and a plurality of arms 2 extend radially from the lower end of the rotor. A trowel blade 3 is pivotally mounted for tilting movement about the respective arm and is movable from a generally horizontal position to an inclined or tilted position.

The rotor is driven by a standard gasoline engine 4 and rotation of the rotor will correspondingly rotate the blades in contact with the concrete slab or other surface to be finished. For safety purposes, a guard 5 encircles the periphery of the trowel blades 3.

A tubular handle 6 extends upwardly at an angle from the rotor and a pair of hand grips 7 extend outwardly from the upper end of the handle. The operator by gripping the hand grips 7 can move the trowel over the surface of the concrete slab as the blades 3 are rotated.

Figure 2:
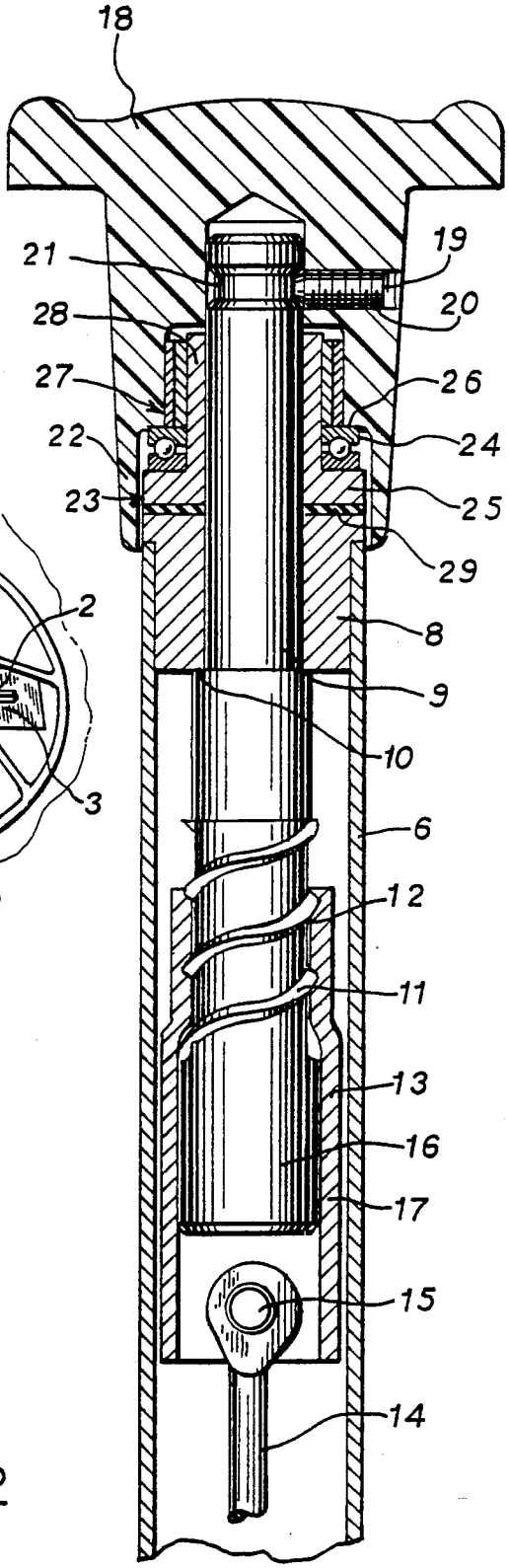
FIG. 2 is a longitudinal section of the handle showing the pitch control mechanism.

The pitch control mechanism of the invention is illustrated in FIG. 2 and includes a metal cap 8, which is secured within the upper end of tubular handle 6. A shaft or rod 9 is located within the central opening of cap 8 and shaft 9 is provided with an annular shoulder 10 against which the lower end of cap 8 bears.

Shaft 9 is provided with an external thread 11, which is engaged with the internal thread 12 of tubular sleeve 13. Threads 11 and 12 have a relatively low pitch in the range of two to six threads per inch.

The lower end of sleeve 13 is connected to an operating cable 14 by means of a pin 15 which extends transversely across the sleeve. Cable 14 extends downwardly through the handle and is connected in a conventional manner to the crankarms of the respective trowel blades 3. The connection can be similar to that described in PCT application WO87/00221

With this arrangement, rotation of shaft 9 will cause the sleeve 13 to move axially relative to handle 6. Upward threading movement of sleeve 13 relative to shaft 9 will apply tension to the cable 14 to thereby pivot the blades 3 from a horizontal position toward an inclined or tilted position. Conversely, downward unthreading movement of sleeve 13 relative to shaft 9 will slacken the cable and permit the weight of the machine to tilt the blades from the tilted position back to the horizontal position.

The lower end of shaft 9 is enlarged, as indicated by 16, and is received within the enlarged lower end 17 of sleeve 13. The enlarged end 16 prevents the shaft from being threaded out of the sleeve.

Connected to the upper end of shaft 9 is a hand knob 18. A set screw 19 is threaded within an opening 20 in knob 18 and is engaged with a circumferential groove in shaft 21, thus securing the knob to the end of shaft 9.

The lower end of knob 18 is provided with a peripheral skirt 22 and a hub 23 is disposed around the upper end of shaft 9 and is located inwardly of skirt 22.

A thrust bearing 24 is positioned between an outwardly extending flange 25 on hub 23 and an internal shoulder 26 on knob 18. Thrust bearing 24 acts to journal the knob 18 and shaft 9 as the knob is rotated in a direction to put tension on cable 14 and tilt the blades 3.

In addition, a one-way clutch 27, such as that sold under the tradename Torrington roller clutch, is positioned between the upper stem 28 of hub 23 and the skirt 22 of the knob. Clutch 27 is designed to permit rotation of the knob 18 and shaft 19 relative to hub 23 when the knob is rotated in a direction to put tension on cable 14 and tilt the trowel bases from a horizontal to a tilted or inclined position, but the clutch will prevent rotation of knob 18 and shaft 9 relative to hub 23 in the opposite direction.

Located between the lower end of hub 23 and the upper end of cap 8 is a washer 29 having a relatively high coefficient of friction. Washer 29 can be formed of metal or of a brake lining type of fibers material. As clutch 27 prevents relative rotation of knob 18 and shaft 9 relative to the hub 23 in a direction to put slack in cable 14, thrust bearing 24 is rendered inoperative, and the hub will rotate relative to the washer 29. As the washer 29 provides a relatively high coefficient of friction, the threaded connection between threads 11 and 12 will not back off due to the weight of the machine acting on the tilted blades. However, the blades can be tilted from the inclined back toward the horizontal position by rotation of the knob 18.

In operation, the blades 3 are tilted from the horizontal position to an inclined position by rotting knob 18 in a direction to thread sleeve 13 onto shaft 9, thus causing sleeve 13 to move axially in handle 6 and applying tension through cable 14 to tilt the blades. Shaft 9 and attached knob 18 rotate relative to hub 23 on thrust bearing 24. One-way clutch 27 prevents reverse rotation of knob 18 relative to hub 23, in effect locking the knob to the hub, so that the contact between the hub and the high friction washer 19 will prevent free unthreading of shaft 9 and sleeve 13, thus maintaining the blades 3 at the selected pitch.

To reduce the pitch, knob 18 is rotated in the opposite direction, causing hub 23 to rotate against thrust washer 29.

The invention provides a journalling mechanism which offers relatively low frictional resistance when the knob is rotated in a direction to tilt the blades from the horizontal to the inclined position, and yet provides increased frictional resistance against rotation in the opposite direction, thus preventing free backing off of the threaded connection due to the weight of the machine acting on the tilted or inclined blades.

Due to the threaded connection 11,12, the pitch control mechanism provides infinite adjustment, as opposed to lever systems which provide only incremental adjustment.

Various modes of carrying out the invention are contemplated as being within the scope of the following claims particularly pointing out and distinctly claiming the subject matter which is regarded as the invention.

We claim:

1. In a machine for finishing a surface and having a plurality of rotatable trowel blades, a mechanism for adjusting the pitch of the blades comprising, an outer fixed housing, a first member slidably disposed within said housing and operably connected to said blades and having a first thread, a second member having a second thread engaged with the first thread, actuating means disposed outside of said housing for rotating said second member relative to said first member to move said first member axially and thereby change the pitch of said blades, rotation of said second member in a first direction causing said blades to tilt from a horizontal position to an inclined position and rotation of said second member in the opposite direction causing said blades to tilt from the inclined position toward the horizontal position, and journalling means for journalling said second member for rotation relative to said housing, said journalling means constructed and arranged to provide a first frictional resistance when said second member is rotated in said first direction and to provide a second frictional resistance greater than said first frictional resistance when the second member is rotated in the opposite direction to thereby prevent free rotation of said second member in said opposite direction caused by the weight of the machine acting on the tilted blades.

2. The machine of claim 1, wherein said actuating means includes a hand knob connected to said second member.

3. The machine of claim 1, wherein said first member comprises a tubular sleeve and said first thread is an internal thread, said second thread is an external thread on said second member.

4. In a machine for finishing a surface and having a plurality of rotatable trowel blades, a mechanism for adjusting the pitch of the blades, comprising a fixed support, a first member operably connected to said blades and having a first thread, a second member including a hand knob and having a second thread engaged with said first thread, a hub mounted on said second member, first thrust bearing means interconnecting said knob and said hub for journalling said knob and said second member when said knob is rotated in a first direction to cause said blades to tilt from the horizontal position to an inclined position, second thrust bearing means having a higher coefficient of friction than said first thrust bearing means and disposed between said hub and said support, and one way clutch means interconnecting said knob and said hub and constructed and arranged such that rotation of said knob in a direction to cause said blades to tilt from said tilted position to the horizontal position will lock said knob to said hub, said knob and said hub then being journalled on said second thrust bearing means.

5. The machine of claim 4, wherein said support comprises an annular cap disposed around said second member.

6. The machine of claim 4, wherein said hub is provided with an outwardly extending flange and a cylindrical section, said first thrust bearing means engaged with said flange and said clutch means engaged with said cylindrical section.

7. The machine of claim 4, wherein said second thrust bearing means comprises a fibrous material.

8. A surface finishing machine, comprising a supporting structure, a rotor carried by said supporting structure, a plurality of blades extending outwardly from said rotor and disposed to rotate in contact with a surface to be finished, a tubular handle extending upwardly from said structure, a sleeve mounted for axial movement within said handle, flexible connecting means connecting said sleeve to said blades for tilting each blades about a horizontal axis, a shaft threaded to said sleeve with the threaded connection between said shaft and said sleeve having from two to six threads per inch, a knob connected to the upper end of said shaft, an annular hub disposed around said shaft and disposed inwardly of said knob, first thrust bearing means interconnecting said knob and said hub for journalling said knob and said shaft for rotation as the knob is rotated in a first direction to cause said blades to move from the horizontal position to a tilted position, second thrust bearing means interconnecting said hub and said handle and having a higher coefficient of friction than said first thrust bearing means, and one-way clutch means interconnecting said knob and said hub for permitting rotation of said knob relative to said hub in said first direction but preventing rotation of said knob relative to said hub in the opposite direction, said second thrust bearing means journalling said knob and said shaft for rotation when said knob is rotated in said opposite direction to cause the blades to move from the tilted position toward the horizontal position.

9. The machine of claim 8, wherein said knob is provided with a peripheral skirt defining an internal shoulder, said hub having a laterally extending flange spaced axially from said shoulder, said first thrust bearing means interposed between said shoulder and said flange.

10. The machine of claim 9 wherein said hub is provided with a cylindrical section spaced radially inward of said skirt and said clutch means is disposed between said cylindrical section and said skirt.

11. The machine of claims 10, wherein said second thrust bearing means is interposed between the lower surface of said flange and said handle.

12. In a machine for finishing a surface and having a plurality of rotatable trowel blades, a mechanism for adjusting the pitch of the blades comprising, an outer fixed housing, a first member disposed with said housing and operably connected to said blades and having a first thread, a second member having a second thread engaged with the first thread, actuating means disposed outside of said housing for rotating said second member relative to said first member to move said first member axially and thereby change the pitch of said blades, rotation of said second member in a first direction causing said blades to tilt from a horizontal position to an inclined position and rotation of said second member in the opposite direction causing said blades to tilt from the inclined position toward the horizontal position, first bearing means for mounting said second member for rotation relative to said housing in said first direction, second bearing means separate from said first bearing means for mounting said second member for rotation relative to said housing in said opposite direction, said second bearing means having a greater frictional resistance than said first bearing means to thereby prevent free rotation of said second member in said opposite direction caused by the weight of the machine acting on the tilted blades.

* * * * *